United States Patent [19]

Wright

[11] Patent Number: 4,561,653

[45] Date of Patent: Dec. 31, 1985

[54] PORTABLE SOFTBALL PITCHING MOUND

[76] Inventor: Robert L. Wright, 4221 - 75th St., Des Moines, Iowa 50322

[21] Appl. No.: 620,275

[22] Filed: Jun. 13, 1984

[51] Int. Cl.[4] ..... A63B 71/00

[52] U.S. Cl. ..... 273/25

[58] Field of Search ..... 273/25; D21/199

[56] References Cited

U.S. PATENT DOCUMENTS

| | | | |
|---|---|---|---|
| 3,181,863 | 5/1965 | Nellimore | 273/25 |
| 3,479,028 | 11/1969 | Goeders | 273/25 |
| 3,703,285 | 11/1972 | Perry | 273/25 |
| 3,837,646 | 9/1974 | Goeders | 273/25 |
| 4,063,729 | 12/1977 | Holloway | 273/25 |
| 4,306,718 | 12/1981 | Goeders | 273/25 |

*Primary Examiner*—Richard C. Pinkham
*Assistant Examiner*—T. Brown
*Attorney, Agent, or Firm*—Zarley, McKee, Thomte, Voorhees & Sease

[57] ABSTRACT

The portable softball pitching mound of the present invention comprises a Fiberglas shell member having forward and rearward ends and opposite side portions. A pitching rubber is detachably mounted upon the upper surface of the shell member. The upper surface area of the shell member behind the pitching rubber is substantially flat and coplanar with the upper surface of the rubber. The area of the shell immediately adjacent to the forward edge of the rubber slopes forwardly and downwardly to form a push-off area terminating in a less inclined downwardly sloping resilient drag area extending to the forward edge of the shell member. The distance from the forward edge of the pitching rubber to the forward edge of the shell member is less than the length of a pitcher's stride. The shell is constructed of reinforced Fiberglas and the upper surface is covered with a layer of artificial turf.

12 Claims, 6 Drawing Figures

PORTABLE SOFTBALL PITCHING MOUND

BACKGROUND OF THE INVENTION

Portable pitching mounds for use indoors and outdoors are well known for practicing by and training of baseball pitchers. However, such baseball mounds are not suitable for training of and practice by fast pitch softball pitchers. The differences in the rules and the pitching motions of softball and baseball or hardball require different pitching mounds. For example, a baseball pitcher's stride is much longer than that of a softball pitcher. Also, the momentum of a baseball pitcher carries his body such that a second step is normally taken by the foot initially placed on or adjacent to the pitching rubber. In comparison, a softball pitcher's foot that is initially on the rubber normally drags along the mound in front of the rubber.

Due to the differences in pitching motion, the area immediately in front of the pitching rubber has different characteristics. The area wherein a softball pitcher normally drags the trailing foot is softer than the same area on a baseball mound wherein little if any contact is made by the pitcher's foot. Also, the shape of the mound is different due to the difference in pitching motions. A baseball mound normally is convex while a softball mound has a flatter surface sloping downwardly from the rubber towards home plate.

Therefore, a primary objective of the present invention is the provision of a portable mound which can be used indoors or outdoors by fast pitch softball pitchers.

A further objective of the present invention is a portable mound which simulates actual softball diamond conditions.

Another objective of the present invention is a provision of a softball pitching mound which can be used in training fast pitch pitchers so as to facilitate an in plane pitch while encouraging pivot foot push and drag.

Still another objective of the present invention is the provision of a portable softball pitching mound which enhances the entire pitching motion includng pivot, weight shift, snap, leg drag, arm rotation, stride and follow-through.

A further objective of the present invention is the provision of a portable softball pitching mound which is light weight yet durable and safe in use.

SUMMARY OF THE INVENTION

The portable fast pitch softball mound of the present invention is formed from a reinforced Fiberglas shell having forward and rearward ends and opposite side portions. A pitching rubber is mounted upon the upper surface of the Fiberglas shell. The area of the shell extending rearwardly from the pitching rubber is substantially flat and coplanar with the upper surface of the rubber while the area of the shell immediately adjacent to the forward edge of the pitching rubber slopes forwardly and downwardly to form a push-off area terminating in a less inclined, planar, forwardly sloping, flexible drag area extending to the forward edge of the shell member. The distance from the forward edge of the pitching rubber to the forward edge of the Fiberglas shell is less than a length of the pitcher's stride, such that the pitcher's first step is off of the mound and onto the flat supporting surface.

The peripheral edge of the shell member is flat so that the mound can be secured by any convenient means to a supporting surface, such as by tape, friction-resistant material, or ground penetrating stakes. The upper surface of the shell is covered with a layer of artificial turf.

DETAILED DESCRIPTION OF THE DRAWINGS

Figure 1:
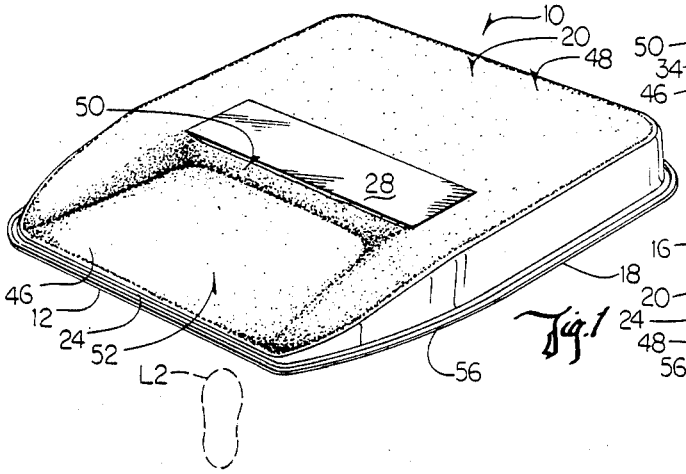
FIG. 1 is a perspective view of the portable pitching mound of the present invention.

The numeral 10 generally designates the portable pitching mound for use by fast pitch softball pitchers. Mound 10 has a forward edge 12, a rearward edge 14, opposite side edges 16 and 18, an upper surface 20, and a lower surface 22. A substantially flat peripheral flange 24 extends around the perimeter of mound 10. The mound is constructed of reinforced Fiberglas so as to be lightweight and durable. Reinforcement members 26 may be molded into the Fiberglas to provide the necessary structural rigidity.

A pitching plate or rubber 28 is secured to upper surface 20 of mound 10 by a securing assembly 30. Rubber 28 has a forward edge 34, a rearward edge 36, and an upper surface 38. Securing assembly 30 may be any conventional attachment means, such as nut 40, bolt 42, and washer 44. Preferably, securing assembly 30 connects rubber 28 to mound 10 from the underneath side of the mound without extending through rubber 28 such that upper surface 38 is free from obstructions. Also, it is desirable that rubber 28 not be permanently attached to mound 10 such that the rubber can be replaced as it becomes worn or damaged.

Upper surface 20 of mound 10 is covered with a layer of artificial turf 46. The rearward portion 48 of mound 10 extending rearwardly from the rearward edge 36 of rubber 28 is substantially flat and coplanar with upper surface 38 of rubber 28. The portion of the mound immediately adjacent the forward edge 34 of rubber 28 slopes forwardly and downwardly to form a push-off area 50 which terminates in a planar drag area 52 sloping forwardly and extending to forward edge 12 of mound 10. Drag area 52 has opposite sides each of which is bounded by a downwardly sloping shoulder 53 extending inwardly from upper surface area 12 of mound 10. Drag area 52 is inclined to a lesser degree than push-off area 50.

Forward edge 12, rearward edge 14 and opposite sides 16 and 18 of mound 10 are preferably 40 inches in length. Rubber 28 is regulation size, 6"×24". Upper surface 38 of rubber 28 is approximately 2½ inches above the supporting surface and the distance from forward edge 34 of rubber 28 to forward edge 12 of mound 10 is approximately 16 inches. The mound is thus designed for use by fast pitch softball pitchers but is unsuitable for use by baseball pitchers due to the differences in pitching motions and the shape and dimensions of the respective mounds.

The construction of mound 10 is such as to simulate actual field conditions. No reinforcing is provided in the push-off area 50 or drag area 52. Drag area 52 is thus somewhat flexible or resilient as is the corresponding area on an actual softball diamond. The angle and flexibility of the drag area promotes comfort and pitching effectiveness by encouraging proper pitching motion. For example, when compared to pitching off of a flat surface, mound 10 enhances the entire pitching motion, including pivot, weight shift, snap, leg drag, arm rotation, stride and follow-through. Mound 10 mitigates against "crow-hopping" such that a pitcher can develop a legal pitch. The footing on mound 10 is secure and the modest pliability of the drag area promotes physiological safety.

Figure 2:
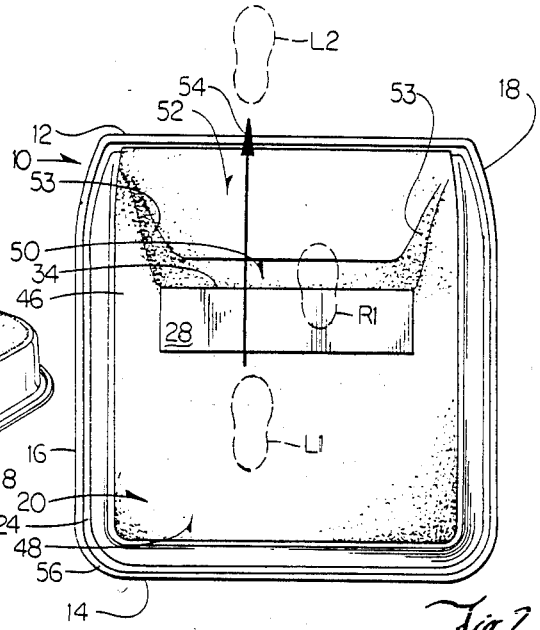
FIG. 2 is a top plan view of the mound showing a right-handed pitcher's first stride in the pitching motion.
Figure 3:
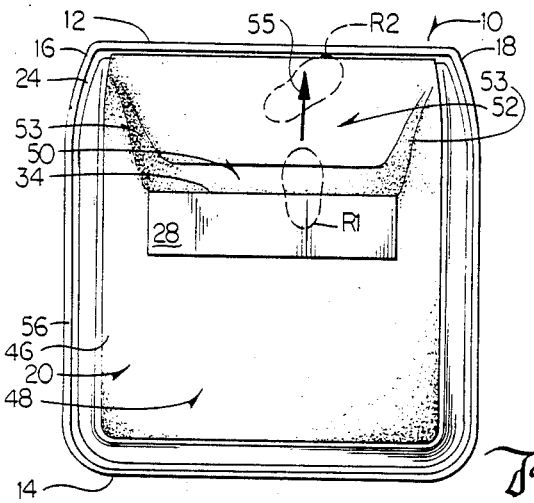
FIG. 3 is similar to FIG. 2 illustrating the trailing foot drag as the pitching motion is completed.
Figure 4:
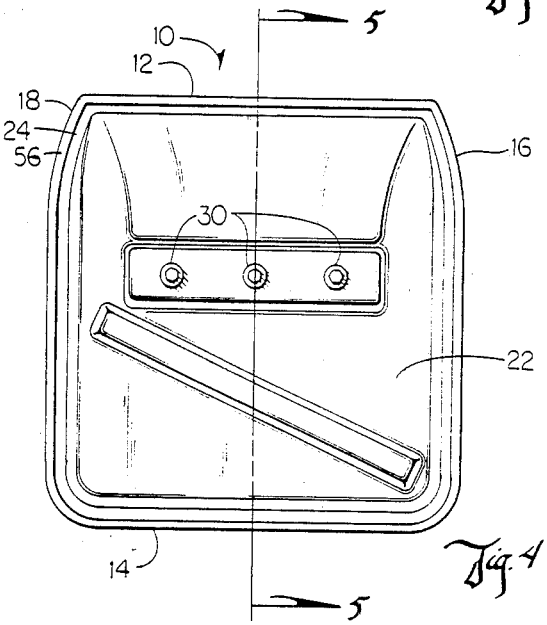
FIG. 4 is a bottom plan view showing the underneath side of the mound.
Figure 5:
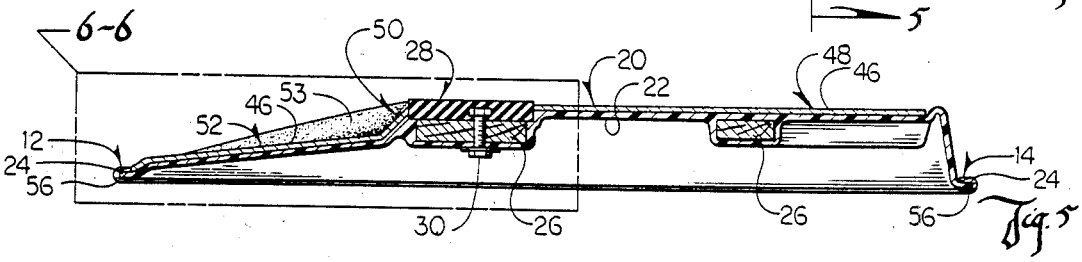
FIG. 5 is a sectional side elevational view taken along line 5—5 of FIG. 4.
Figure 6:
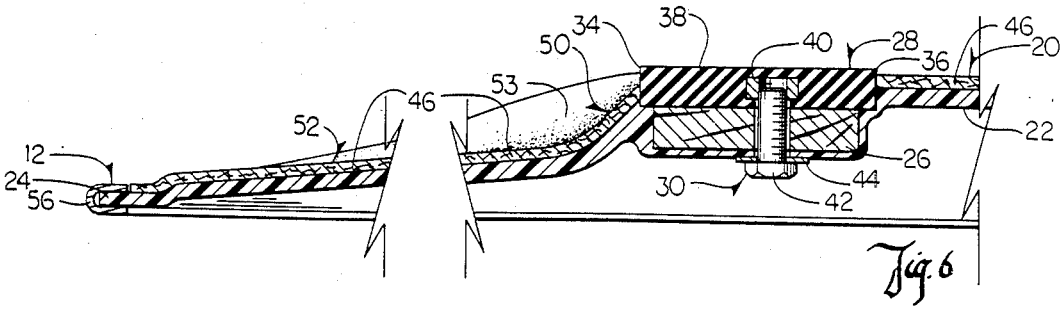
FIG. 6 is an enlarged partial sectional view taken along line 6—6 of FIG. 5.

FIGS. 2 and 3 illustrate the steps a fast pitch softball pitcher takes in executing a pitch. A right-handed pitcher begins with the heel of the right foot on the rubber 28 with the toe of the foot extending forwardly onto push-off area 50, as illustrated by position R1. The left foot of the pitcher begins at position L1 behind rubber 28. As the pitch is executed, the right-handed pitcher strides forwardly with the left foot to position L2 which is completely off of mound 10 and on the flat surface which supports the mound, as indicated by arrow 54. As the pitcher is striding forward with the left foot, the right leg and foot pushes off of push-off area 50, an essential step in throwing a fast pitch. As the pitcher releases the ball, the right foot may pivot outwardly and is dragged along drag area 52 as the pitching motion is completed, as indicated by position R2 and arrow 55 in FIG. 3.

Mound 10 is designed for indoor or outdoor use and may be secured to a supporting surface by any convenient means. For example, tape may be attached to peripheral flange 24 and to a floor when the mound is used indoors. Alternatively, a friction-resistant material 56 may be attached to flange 24 to prevent sliding of mound 10 upon a smooth surface. When mound 10 is used outdoors, stakes or the like may extend through holes (not shown) in flange 24 or may otherwise engage the mound so as to hold it in place upon the ground. Also, the mound is designed so that one mound may be stacked upon another for storage purposes.

From the foregoing, it can be seen that the portable softball pitching mound of the present invention accomplishes at least all of the stated objectives.

What is claimed is:

1. A portable softball pitching mound, comprising:

a shell member having forward and rearward ends, opposite side portions and an upper surface area and being adapted to be supported by a support surface;

a pitching rubber mounted on said upper surface area and having forward and rearward edges and opposite side edges and an upper surface area;

said upper surface of said shell member extending substantially horizontally rearwardly from said rearward edge of said pitching rubber being substantially flat and coplanar with said upper surface area of said pitching rubber;

said upper surface area of said shell member immediately adjacent said forward edge of said pitching rubber having a first planar surface area sloping forwardly and downwardly to form a push-off area and merging into a second planar surface area sloping downwardly and forwardly to provide a resilient drag area extending to said forward edge of said shell member, said first surface having an inclination relative to said horizontal surface greater than said second surface relative to said horizontal surface, and the distance from said forward edge of said pitching rubber to said forward edge of said shell member being less than the length of the pitching stride of the pitcher such that the first step of the foot starting on the upper surface of the shell member is on to the support surface forwardly of said shell member and the other foot is pivoted on said rubber and push-off area and then dragged into said flexible area so as to simulate actual outdoor field conditions.

2. The pitching mound according to claim 1 wherein said shell member has a flat peripheral supporting flange.

3. The pitching mound according to claim 2 further comprising a frictional material secured to said flange to cause said shell member to frictionally engage a supporting surface.

4. The pitching mound according to claim 1 further comprising a layer of turf material secured to said upper surface area of said shell members.

5. The pitching mound according to claim 1 further comprising means for releaseably securing said pitching rubber to said shell member whereby said pitching rubber is replaceable.

6. The pitching mound according to claim 1 wherein said drag area has opposite sides each of which is bounded by a downwardly sloping shoulder extending inwardly from said upper surface area of said mound.

7. The pitching mound according to claim 1 wherein said forward and rearward edges and said opposite sides of said shell member are each approximately 40 inches in length.

8. The pitching mound according to claim 1 wherein the distance from said forward edge of said rubber to said forward edge of said shell member is approximately 16 inches.

9. The pitching mound according to claim 1 wherein only the peripheral edges of said shell member engage said support surface for support thereby.

10. The pitching mound according to claim 1 wherein said shell member is constructed of lightweight, substantially rigid yet resilient material.

11. The pitching mound according to claim 1 further comprising reinforcing means in said shell member rearwardly of said rubber for reducing the resiliency of said upper surface area of said shell member extending rearwardly from said rubber.

12. The pitching mound according to claim 1 wherein said shell member is free of reinforcing means in said drag area such that said drag area is flexible.

* * * * *